United States Patent [19]

Rands, deceased et al.

[11] Patent Number: 4,665,657

[45] Date of Patent: May 19, 1987

[54] CENTERLESS FLEXIBLE EXTERNAL HONING APPARATUS

[76] Inventors: Steve A. Rands, deceased, late of Pasadena, Calif.; by Mary Rands, executor, 3315 Villa Knolls Dr., Pasadena, Calif. 91107

[21] Appl. No.: 357,631

[22] Filed: Mar. 12, 1982

[51] Int. Cl.[4] ..... B24B 33/04

[52] U.S. Cl. ..... 51/103 TF; 51/80 A; 51/334; 15/88; 15/104.04

[58] Field of Search ..... 51/80 A, 88, 103 TF, 51/103 R, 330, 331, 332, 334, 357; 15/88, 104.01 R, 104.04

[56] References Cited

U.S. PATENT DOCUMENTS

| | | | |
|---|---|---|---|
| 162,155 | 4/1875 | Cook | 51/103 R |
| 1,464,775 | 8/1923 | Reuter | 51/80 A |
| 1,585,983 | 5/1926 | Heim | 51/103 TF X |
| 2,319,998 | 5/1943 | Jaecker | 51/88 |
| 3,258,804 | 7/1966 | Fowle | 51/103 R X |
| 3,384,915 | 5/1968 | Rands | 51/334 X |
| 3,871,139 | 3/1975 | Rands | 51/334 |
| 4,151,625 | 5/1979 | Stevanovich | 15/88 X |

*Primary Examiner*—Robert P. Olszewski

[57] ABSTRACT

A centerless external honing and/or grinding apparatus wherein abrasive material is flexibly mounted around a longitudinal workpiece-receiving recess for flexibly honing and/or grinding the exterior curved surface of a workpiece while it is fed longitudinally forwardly through the workpiece-receiving recess from an input end thereof to an output end thereof, and adapted to impart a desired type of surface finish, usually what is referred to hereinafter as a plateaued surface finish, to a curved exterior surface of the workpiece, which occurs by reason of the flexible mounting of the abrasive material (usually, abrasive particles) and the self-centering action produced by the centerless honing or grinding construction of three similarly longitudinally oriented, laterally and vertically adjacent roller members arranged cross-sectionally in a generally polygonal (usually triangular) array or configuration and with at least one and, in certain cases two, and in other cases, all three, of the longitudinal roller members being exteriorly and flexibly provided with abrasive particles and with at least one, and, in certain cases two, and in certain other cases all three of the longitudinal roller members being positively power-rotated, in certain instances, similarly and in other instances, in opposition to each other. Feeding is provided by a helical arrangement of exterior abrasive particles on the roller members and differentially slippingly power-rotated to apply a net forwardly directed force component to a workpiece whereby to feed same forwardly between input and output ends of a workpiece recess.

2 Claims, 8 Drawing Figures

FIG. 8
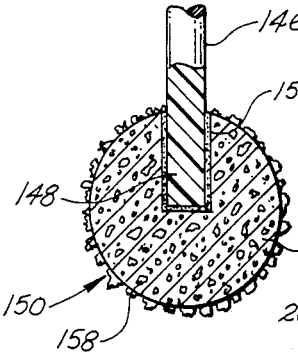
FIG. 5
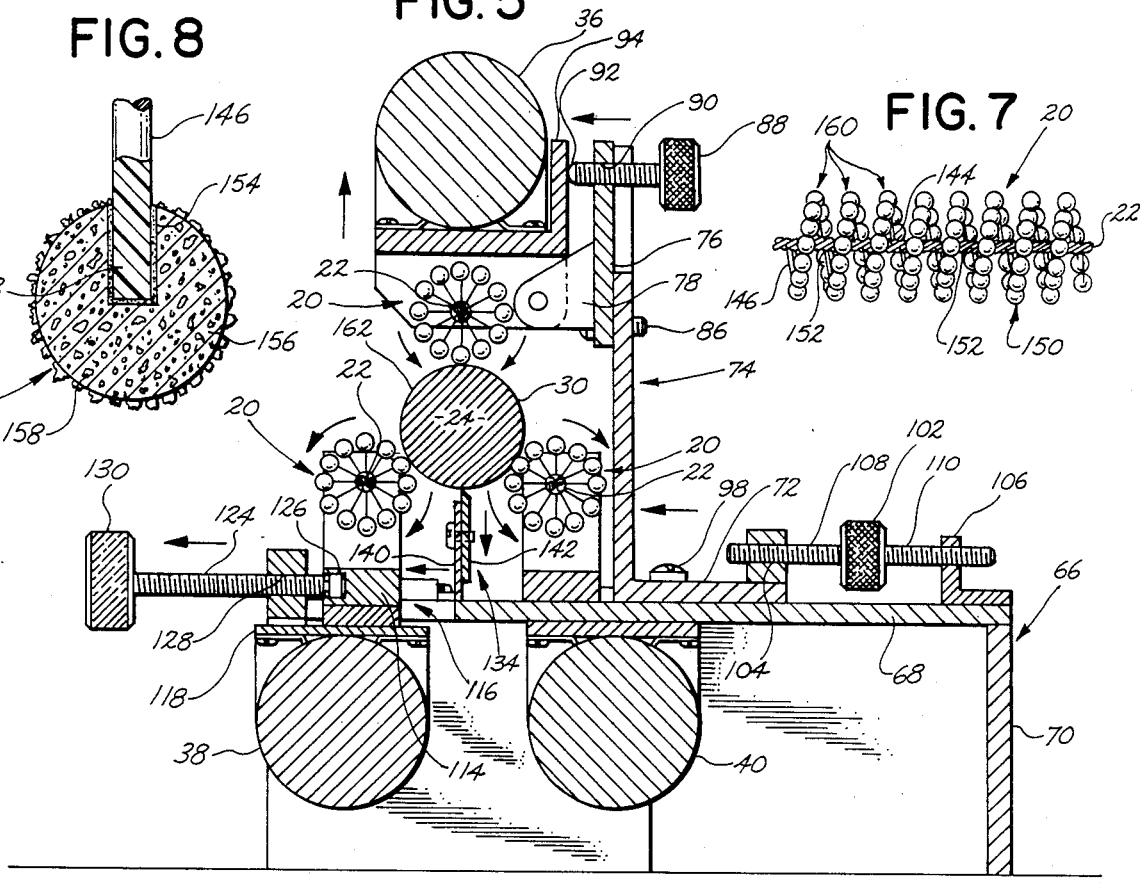
FIG. 7
FIG. 6
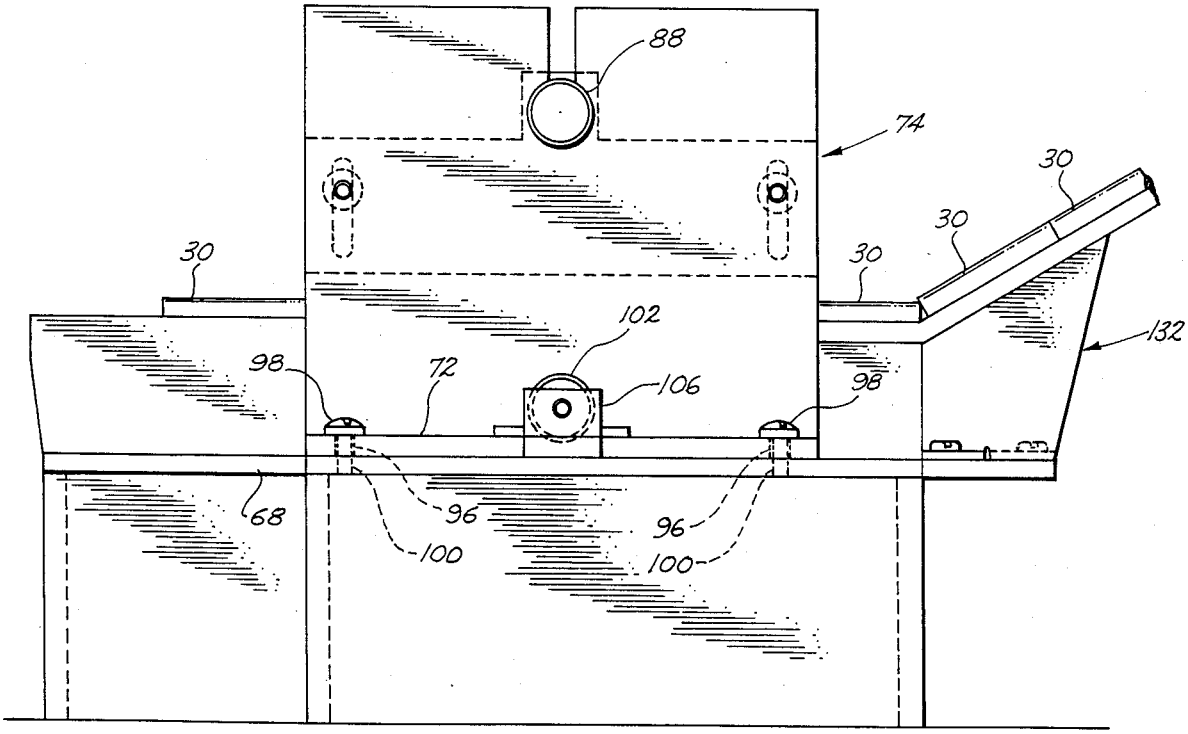

CENTERLESS FLEXIBLE EXTERNAL HONING APPARATUS

BACKGROUND OF THE INVENTION

The field of the invention is generally that of honing and grinding, and, more particularly, that of the honing and grinding of curved exterior workpiece surfaces and, especially, and more particularly, with respect to centerless honing or grinding arrangements for such curved external workpiece surfaces. Certain prior art centerless grinding constructions have been developed in the past and have employed three wheels or cylinders triangularly mounted with respect to each other so as to have a grinding space between the three grinding wheels or cylinders where a part which is to be ground or shaped is effectively placed at a location substantially at the center of the triangular shape defined by the three grinding wheels or cylinders. In such a prior art centerless grinder construction, one of the wheels or cylinders is normally made of rubber or the like and is used as the driving mechanism to rotate the workpiece which is to be ground and which is held in the so-called "centerless fashion" by the other two wheels or cylinders which are normally hard and brittle grinding wheels of various lengths, sizes and grinding grit composition. If a part is to be shaped, then the opposing shape is ground into one of the abrasive wheels so that the grinding of the workpiece or part will effectively be a form of abrasive machining of the part down to its proper size and shape. In this type of arrangement, the other wheel is an abrasive wheel operated under power and it operates to apply pressure and to aid in the grinding.

One of the major disadvantages of a prior art centerless grinder of the type referred to above arises primarily from the fact that the abrasive grinding wheels are usually constructed of a very rigid, relatively brittle material which not only has a chance to break during usage because of its brittleness, but which also tends to wear down and modify the grinding contact thereof with a workpiece unless such wear is fully compensated for and, further, and most important, is the fact that such a prior art type of rigid stone grinding (or effective machining by such grinding action) of a workpiece develops what can be referred to as a "peaky" finish having a multitude of cut, torn, and folded metal portions which become very evident when viewed by a scanning electron microscope and as is best evidenced by such scanning electron miscroscopic pictures. In addition, any steps or recesses in such a prior art workpiece will normally have very sharp edges which, under normal operating conditions, will need to be radiused or deburred.

Such a "peaky" finish, produced by prior art centerless grinders is one where the peaks and valleys, which are the customary micro-profile configuration of such a metal workpiece surface, are area co-extensive with most of the projected surface area of the workpiece—that is, most of any given portion of such a workpiece surface area consists of peaks and valleys, which is highly undesirable when the workpiece surface is intended to movably coact with another abutting workpiece surface, such as in a piston and cylinder (or piston ring around a piston and an adjacent cylinder wall), in a bearing and journal, or the like. The initial "peaky" finish of two such new abutting metal surfaces is the reason for the conventionally required so-called "break-in period" for such new coacting parts. The present inventor has found that if such abutting coacting metal parts are surface-finished with what the present inventor terms a plateaued finish, by which is meant a finish where a substantial portion of the micro-profile peaks of each metal surface, as seen in cross-section, are honed off so as to leave a multitude of such substantially flat or plateaued tops, with a substantial portion of the complete projected area of that part of the surface being comprised of such plateaued tops. When each movably coacting, slideably abutting, metal surface of any apparatus of the type referred to above is of such plateaued surface finish configuration, there is no initial "break-in" required for the apparatus and virtually no damage to the adjacent metal surfaces will occur during even heavy or high-load or high-torque initial operating conditions, such as very frequently occurs in prior art constructions of the type mentioned above having conventionally finished coacting metal surfaces which are of the "peaky" type mentioned above.

It is obvious that it would be highly desirable to provide a honing apparatus of the so-called "centerless" type which would produce such a plateaued finish on a workpiece, and it is precisely such highly desirable and advantageous type of external honing apparatus which is provided by, and in, the present invention and which has advantages of the desirable type either explicit or implicit in the foregoing comments which will readily produce a plateaued surface on a workpiece, thus, virtually completely overcoming the problems, disadvantages and limitations of the above-mentioned type of prior art centerless grinders, and wherein all of the advantages flow from, and occur by reason of, the specific features of the invention pointed out hereinafter and primarily because of the extremely flexible and self-centering mounting of the abrasive particles.

SUMMARY OF THE INVENTION

The present invention comprises a centerless flexible external honing apparatus for honing curved (in many cases, cylindrical) exterior surfaces of a workpiece and includes a workpiece-receiving assembly of multiple (usually three) similar longitudinally adjacently oriented (usually substantially cylindrical) longitudinal effective roller members having similar longitudinally oriented (usually substantially parallel) transversel (usually meaning both laterally and vertically) spaced longitudinal axes, and with at least certain (in a preferred case, each) being mounted for powered rotation around its longitudinal axis. In a preferred form, the transverse spacing between the three longitudinal effective roller members is such as to define a longitudinal workpiece-receiving recess (or region) therebetween (which, in one preferred form, is controllably adjustable) having an input end and an output end with the input end being adapted to axially longitudinally receive a longitudinal workpiece which is intended to be longitudinally fed forwardly along the length of said workpiece-receiving recess and to subsequently forwardly exit from an opposite forward and output end thereof for discharge as a surface-finished (usually an exteriorly plateaued) workpiece.

In a preferred form, any combination of from one to three of said longitudinal effective roller members is effectively provided with power-rotating means (from a common source or from separate sources) coupled thereto for positively power-rotating the corresponding longitudinal effective roller member in a desired direction around its longitudinal axis, which rotation may be in similar senses, opposite senses or any desired combination of similar and opposite senses according to the desired type of workpiece feeding, the forward rate of travel involved in such workpiece feeding and the type and extent of surface honing which it is desired to impart to such a workpiece.

At least one (in certain cases two, and in certain other cases, all three) of said longitudinal effective roller members comprises an abrasive honing flexible body member exteriorly and flexibly provided with, and flexibly mounting, abrasive (particle) means which, in one preferred form, comprises a cured plastic (usually epoxy) resin matrix material adhesively carrying (in a firmly engaged substantially non-detachable and flexibly mounted manner) a quantity of finely-divided particulate abrasive material for exteriorly and flexibly honing a workpiece as it is forwardly fed along the length of said workpiece-receiving recess between input and output ends thereof while said abrasive honing flexible body member is power-rotated.

In one preferred form, each such abrasive honing flexible body member comprises an abrasive honing flexible brush taking the form of a longitudinally disposed bristlemounting base provided with, and firmly mounting, corresponding base ends of a plurality of projecting flexible bristles (usually Nylon bristles, in one preferred form) with each of at least certain of said flexible bristles having an outer end provided with and carrying said abrasive means thereon in the form of an abrasive globule surrounding and centered upon the bristle outer end. In one preferred form, each such abrasive globule comprises a cured plastic (epoxy) resin matrix material adhesively carrying, in a firmly engaged, substantially non-detachable manner, a quantity of finely-divided particulate abrasive material which, in one preferred form, also includes an intervening bridging junction material having both an affinity for the plastic (epoxy) resin matrix material and an affinity for the flexible (Nylon, in one preferred form) plastic material comprising the mounting bristle tip end carrying the abrasive globule and effectively enhancing the firmness and non-removability characteristics of the mounting of the abrasive globule on the bristle tip end.

In a preferred form, the apparatus is effectively provided with forward feeding means positioned for feeding contact with a longitudinal workpiece axially received at the input end of said workpiece-receiving recess and effectively power-operated to positively cause forward movement of such workpiece along the length of said recess from an input end thereof to an output end thereof and for discharge at the output end thereof.

In one preferred form, the above-mentioned effective forward feeding means comprises a longitudinal spiral, screw-like arrangement and orientation of at least certain of the previously-mentioned plurality of abrasive globules, which are so oriented with respect to the direction of powered rotation thereof as to effectively cause said forward feeding of a longitudinal workpiece along said workpiece-receiving recess from input to output ends thereof by reason of the angularly-directed honing contact of said abrasive globules with the exterior surface of such a longitudinal workpiece and, in particular, by reason of a forward force component thereof.

In one preferred form, any or all of the three longitudinal roller members is/are adapted to be mounted for transverse movement toward and away from each other so as to effectively adjust the size of the longitudinal workpiece-receiving recess so as to be suitable for a desired type of flexible honing contact with various different sizes (diameters) of longitudinal workpieces. In one preferred form, this adjustable mounting is accomplished by the provision of controllably adjustable (in certain forms, screw-operated) positioning and mounting means relatively mounting said three longitudinal roller members for relative transverse movement (including either or both lateral and/or vertical movement) toward and away from each other.

In one preferred form, the apparatus is provided with a longitudinal guide and support member adapted to be positioned (usually controllably adjustably positioned) along the bottom of the longitudinal workpiece-receiving recess and cooperable for slideably contacting, supporting, and guiding a longitudinal workpiece as it is forwardly moved along and through the workpiece-receiving recess.

While any or all of the longitudinal roller members is or are adapted to be power-driven by any suitable means, in one preferred form, this may be accomplished by the inclusion of torque-supplying means (usually motor means) and power-transmission means coupling same to driven ones of said longitudinal roller members in a desired manner (usually in a controllably adjustable output-torque-and/or-output-speed-modifying manner.)

OBJECTS OF THE INVENTION

With the above points in mind, it is an object of the present invention to provide a novel centerless external honing apparatus for honing exterior surfaces of a workpiece wherein the honing action on the workpiece is accomplished by power-rotated contact therewith of multiple abrasive particles which are extremely flexibly mounted, and which are effectively self-centering and self-compensating (with respect to surface physical irregularities and/or hardness of a workpiece), which is adapted to produce any desired type of exterior surface finish on a workpiece having any desired type of angular tooth or grain that may be desired and which is further primarily intended to produce a workpiece exterior surface of the previously-explained "plateaued" type.

It is a further object of the invention to provide a centerless flexible external honing apparatus of the character referred to herein, generically and/or specifically, which may include any or all of the features referred to herein, either individually or in combination, and which is of a type adapted to surface finish wide variety of different forms of workpieces and which, further, is of relatively simple, reliable, readily portable construction suitable for ready mass manufacturing, production and distribution of the apparatus in any of its various different forms at reasonable cost, both as to the initial capital cost (including production set up cost) and as to the subsequent per unit manufacturing cost whereby to be conducive to relatively widespread production, distribution and use of the novel apparatus of the present invention for the purposes outlined herein or for any substantially equivalent or similar purposes.

Further objects are implicit in the detailed description which follows hereinafter (which is to be considered as exemplary of, but not specifically limiting, the present invention), and said objects will be apparent to persons skilled in the art after a careful study of the detailed description which follows.

For the purpose of clarifying the nature of the present invention, one exemplary embodiment thereof is illustrated in the hereinbelow-described figures of the accompanying multiple sheets of drawings and is described in detail hereinafter.

BRIEF DESCRIPTION OF THE DRAWINGS

FIG. 5 is a central-plane, cross-sectional view taken substantially along the plane and in the direction indicated by the arrows 5—5 of FIG. 3, with all three of the torque-supplying motor means being not shown in interior detail (because such motor interior detail is well-known in the art) and merely being shown cross-hatched for drawing simplification purposes.

FIG. 6 is a rear or back elevational view of the entire apparatus seen from the back side in elevation from a vantage point exactly the opposite of the vantage point corresponding to the front view shown in FIG. 3.

FIG. 7 is a view of a partially fragmentary nature (with mounting structure and driving pulley structure omitted for reasons of drawing simplification) showing an exemplary one of the three longitudinal roller members in a plan view orientation and is purposely drawn so as to emphasize the spiral relationship of the plurality of abrasive globules carried at the outer ends of flexible bristles of a flexible abrasive honing brush (the form which the longitudinal roller member takes in the exemplary version of the invention illustrated) and with each of the spirally arranged abrasive globules comprising a plurality of adhesively-held abrasive particle means and with the flexible bristles being substantially radially directed and both spirally angularly spaced and longitudinally spaced relative to each other whereby do define one particular type of very effective longitudinal flexible abrasive honing brush which may be said to be of substantially circular shape at any particular cross-section and which, in the example illustrated, may also be said to be substantially cylindrical by reason of having substantially the same circular diameter at any particular cross-sectional location along the length thereof. While the rotating and mounting structure is not shown in FIG. 7, it will be understood that said parts are omitted for drawing simplification and clarification and that actually, the brush is axially rotatively mounted as is clearly shown in the other figures of the drawings, whereby to continually present fresh abrasive surfaces to a workpiece throughout the course of the brushes' rotation around its longitudinal axis (or axle).

FIG. 8 is a greatly enlarged, partially broken away and fragmentary, sectional view of a representative bristle tip end and a representative abrasive globule carried thereby.

DESCRIPTION OF THE PREFERRED EMBODIMENT

Figure 1:
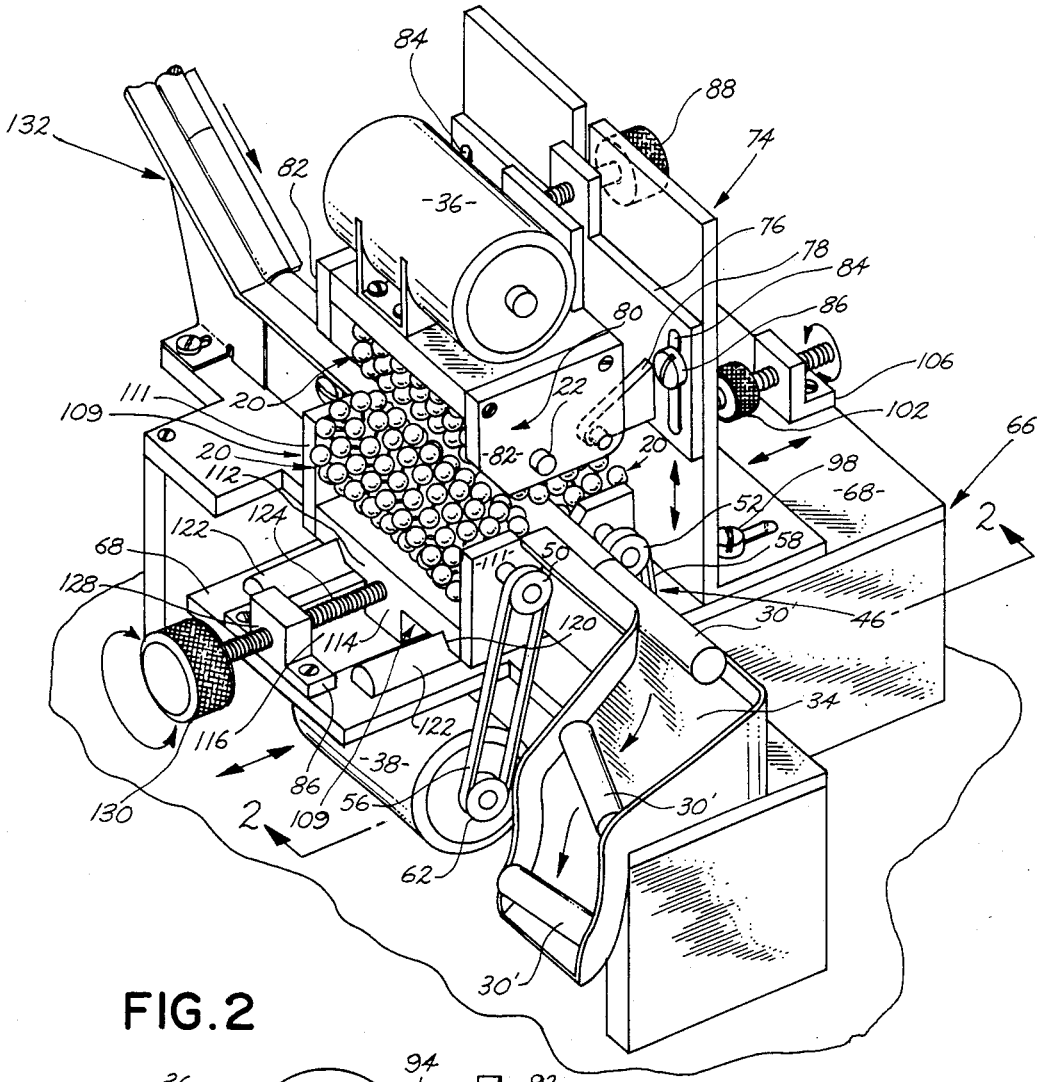
FIG. 1 is an isometric, three-dimensional pictorial view showing the illustrative embodiment of the present invention as viewed from a position slightly above, laterally in front of, and at one side of the exemplary apparatus, and with representative but non-limiting types of input and output (discharge) means being shown in operative relationship to the exemplary apparatus.
Figure 2:
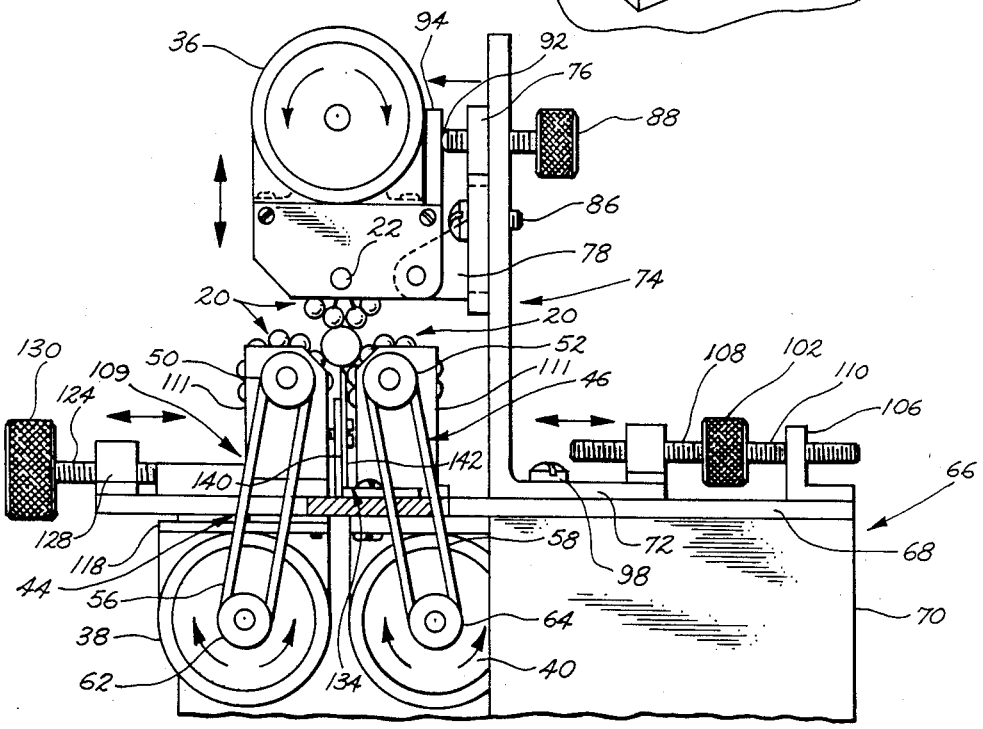
FIG. 2 is an end elevational view of the apparatus (with the representative input and output means removed for drawing simplification purposes) taken substantially along the plane and in the direction indicated by the arrows 2—2 of FIG. 1.
Figure 3:
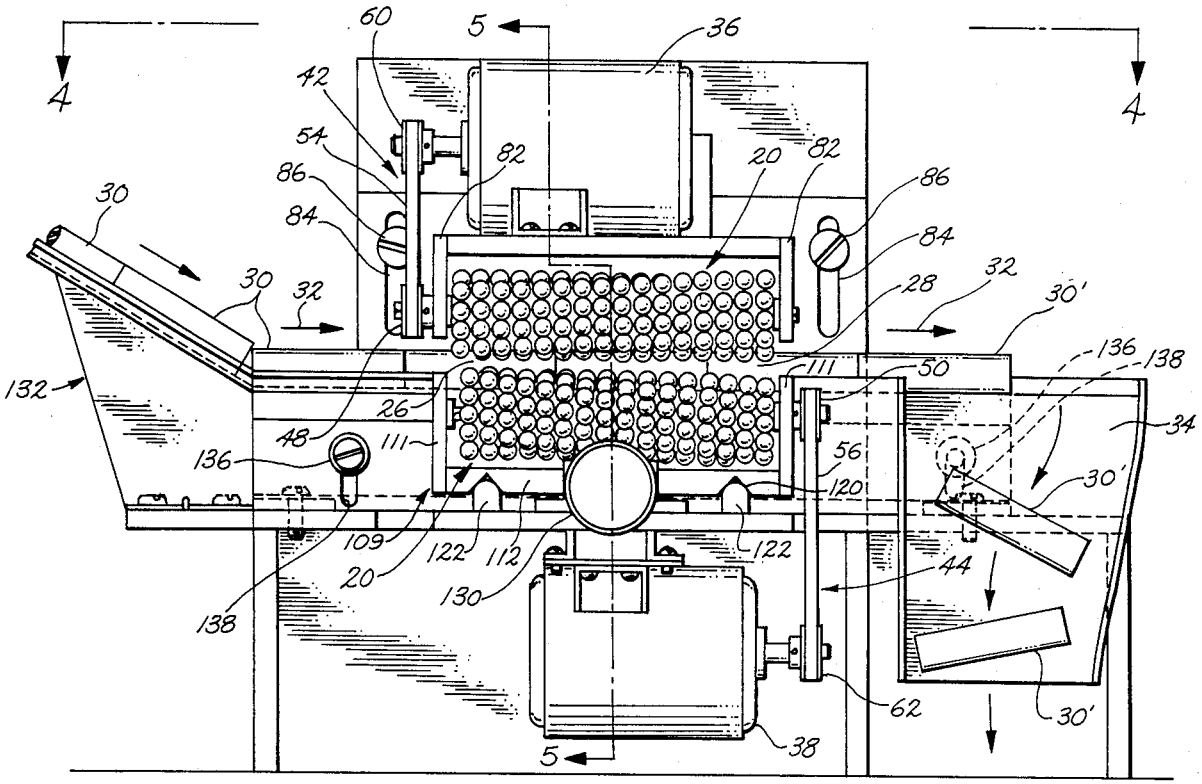
FIG. 3 is a front elevational view of the entire apparatus of FIG. 1.
Figure 4:
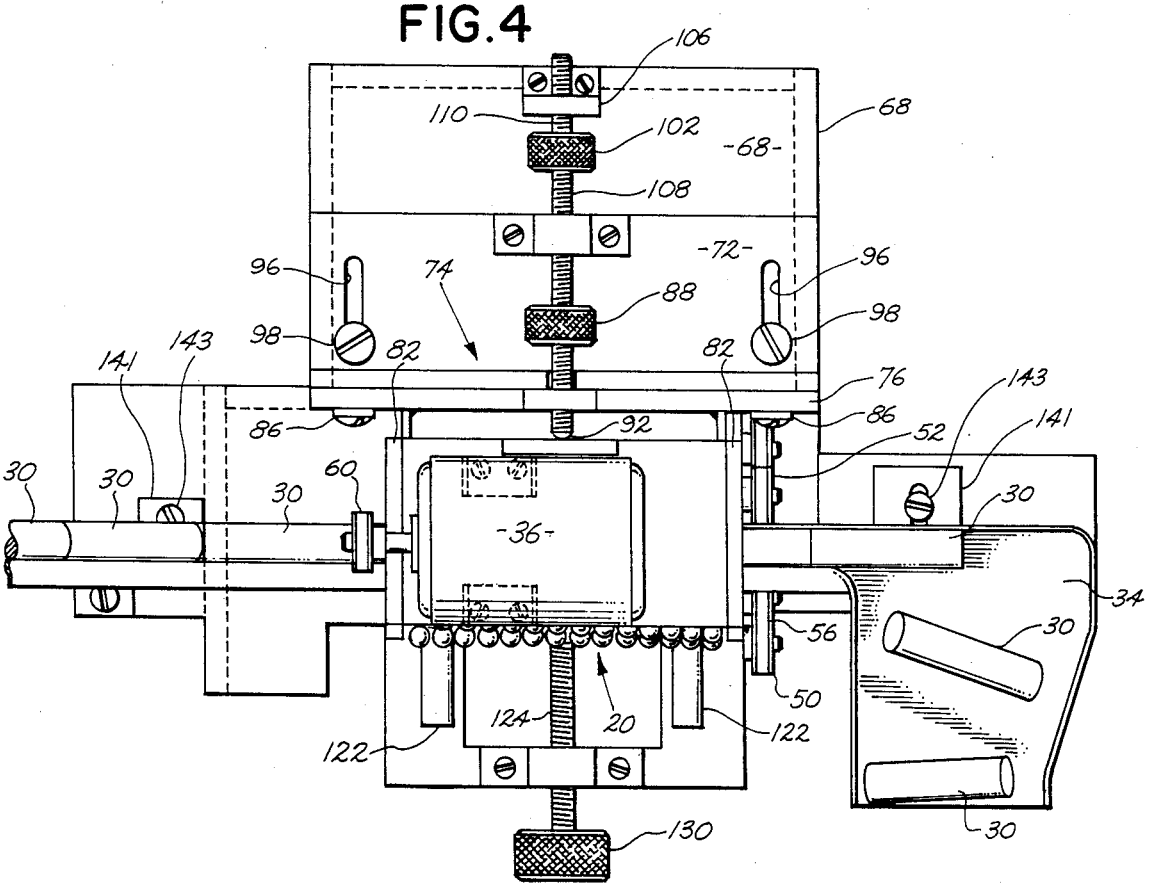
FIG. 4 is a top planview taken substantially along the plane and in the direction indicated by the arrows 4—4 of FIG. 3.

The exemplary centerless flexible external honing apparatus, selected for illustration purposes comprises a workpiece-receiving assembly of three similarly longitudinally adjacently oriented longitudinal effective roller members having similarly longitudinally oriented and transversely spaced longitudinal axes arranged cross-sectionally speaking (or as seen in end elevation) in a generally triangular array or configuration, as is perhaps best shown in the cross-sectional view comprising FIG. 5 where each of the three longitudinal roller members is generally designated by the same reference numeral 20 and where it can be seen that each has a longitudinal axis 22 similarly longitudinally oriented and transversely spaced ("transversely" meaning both laterally and vertically spaced). The three longitudinal axes 22 of the three longitudinal effective roller members 20 are mounted for powered rotation, in each case around its own longitudinal axis 22, and with the transverse spacing between the cylindrical exteriors of the three longitudinal effective roller members 20 being such as to effectively define what might be termed a longitudinal workpiece-receiving recess or region, indicated at 24, having an input end 26 and an output end 28 and being adapted to axially longitudinally receive at the input end 26 an exteriorly curved (usually cylindrical) longitudinal workpiece such as any of the plurality of workpieces, each indicated by the reference numeral 30, so that the workpiece 30 can be longitudinally fed forwardly, as indicated by the directional arrows 32, along the length of the workpiece-receiving recess 24 so as to forwardly exit from the opposite or output end 28 of the recess 24 for discharge into a discharge chute 34 as a surface-finished (usually exteriorly plateaued) workpiece 30'.

While, broadly speaking, any or all of the longitudinal roller members 20 may be provided with power-rotating means coupled thereto for positively power-rotating a desired longitudinal roller member 20 in a desired direction around its longitudinal axis, in the exemplary form illustrated, each of the three longitudinal roller members 20 is adapted to be power-rotated and each is provided with power-rotating means effectively coupled thereto for causing rotation of each of the longitudinal roller members 20 in a desired direction of rotation which, in one nonlimiting example shown as best seen in FIG. 5, is counterclockwise in the case of the lower left roller member 20, is clockwise in the case of the right lower roller member 20 and which is illustrated as being either counterclockwise or clockwise in the case of the upper, triangular-apex-positioned roller member 20 of FIG. 5, although either (or both) of the lower ones may be reversed. In the example illustrated, the three power-rotating means mentioned immediately hereinbefore for power-rotating the three roller members 20 take the form of torque-supplying motor means 36, 38 and 40 coupled in each case by power-transmission means, indicated generally at 42, 44 and 46 to a pulley sheave 48, 50 and 52 respectively carried at a corresponding end of each of the three longitudinal axes (effective axles) 22 of each of the three longitudinal roller members 20. Each of the three transmissions 42, 44 and 46 include drive belts 54, 56 and 58 connected, respectively, to the corresponding ones of the three motors 36, 38 and 40 by similar pulleys 60, 62 and 64. However, other power-transmission means may be employed in lieu thereof, including adjustable-ratio power-transmission means if desired. Also any or all of the motor means 36, 38 and 40 may be controllably adjustable as to output torque and/or as to output speed according to the intended type of honing usage of the apparatus and any or all of said motors may also be reversible to control the honing action and also the forward feeding action as will be explained subsequently.

While the three motors 36, 38, and 40 and the three longitudinal roller members 20 may be mounted in any suitable fashion, in the exemplary form illustrated, the mounting of same is provided by a base, indicated generally at 66, which includes an upper horizontally oriented platform member 68 supported by a plurality of downwardly extending edge member 70. The platform member 68 slideably mounts a bottom member 72 of an upwardly extending L-shaped bracket 74 which adjustably carries at the top thereof an intermediate mounting plate 76 which has a pair of projections or ears 78 which mount an inverted U-shaped carrier 80 which carries the motor 36 attached to the top thereof and which pivotally mounts the horizontal axis or axle 22 of the upper longitudinal roller 20 between opposite end walls 82 thereof. Since the intermediate plate 76 has a pair of vertical slots 84 through which fastening screws 86 pass, it is clear that said intermediate plate 76 can be controllably adjusted vertically by merely loosening the two screws 86, making the desired vertical adjustment of the intermediate plate 76, and then retightening the two screws 86. This provides for any desired extent of up or down adjustment (the previously-mentioned transverse movement or adjustment) of both the upper motor 36 and the upper longitudinal roller member 20 as desired or needed for various different honing purposes.

The screw 88 which threadedly passes through an interiorly threaded hole 90 in the intermediate plate 76 and which has an inner abutment end 92 adjacent to an upstanding wall 94 positioned on and extending upwardly from the carrier bracket 80, provides for positive locking of the entire upper carrier 80, carrying both the upper motor 36 and the upper roller member 20 in any adjusted position by merely tightening the screw 88 so as to force the abutment end 92 thereof against the upstanding plate or member 94 in a locking manner.

The lower foot portion 72 of the upstanding bracket member 74 has a pair of transverse slots 96 (which, in this instance, are horizontally laterally directed) which have a pair of vertical screws 98 passing downwardly through the slots 96 for threaded engagement within corresponding portions of the horizontal platform member 68, as is best indicated at 100 in FIG. 6. Thus, it will be understood that the entire upstanding bracket 74 and, consequently, the entire upper carrier 80 mounting the top motor 36 and the top roller member 20, can be transversely moved in either direction (in this case, the transverse movement being in a horizontal lateral direction) by merely loosening the two screws 98 and by turning the knurled thumb wheel 102 in a proper direction for causing relative movement of the threaded receiver block 104 carried by the foot portion 72 of the bracket member 74 toward or away from the fixed upstanding member 106 fixedly attached to the platform member 68. Of course, the knurled knob 102 turns the two threaded shaft portions 108 an 110 with respect to the interior threads carried by the movable block portion 104 of the foot member 72 and the fixed member 106, thus, providing for any desired movement of the entire bracket member 74 in either transverse direction desired, after which, the screws 98 can again be retightened, thus, locking the upstanding bracket member 74 and the carrier 80 (mounting the top motor 36 and the top roller member 20) in any laterally horizontally adjusted position.

The lower left motor 38 and the lower left longitudinal roller member 20 are mounted for transverse movement (in the example illustrated, meaning lateral movement in a horizontal plane) relative to the right lower motor 40 and the right lower longitudinal roller member 20 in one specific exemplary manner, although other equivalent mounting arrangements may be employed in lieu thereof. In the example illustrated, the mcunting arrangement comprises a substantially U-shaped housing 109 having a pair of upstanding end walls 111 which pivotally receive and mount the longitudinal axis or axle 22 of the lower left longitudinal roller member 20 and having an interconnecting bottom wall 112 which has a downwardly directed connection portion 114 which extends downwardly through a slot 116 in the underlying portion of the horizontal platform member 68. The downwardly extending connection portion 114 is attached to a horizontal motor mounting plate 118 which the left bottom motor 38 is attached in a depending manner. The bottom portion 112 of the housing 109 has a pair of grooves 120 which ride on a pair of parallel track or rail members 122 mounted on the top surface of the platform member 68 and extending along each side of the slot 116, so as to movably mount the entire housing 108 for movement along said pair of tracks or rails 122 in either lateral or transverse direction toward or away from the corresponding lower right motor 40 and lower right roller member 20, as desired or needed for various different types of intended honing usage of the apparatus.

The above-mentioned type of transverse movement of the entire housing 109 (and consequently, of the lower left roller member 20 and the underlying lower left motor 38) is accomplished by a threaded screw 124 which has an inner end coupled as indicated at 126 (see FIG. 5) to the depending connection portion 114 and which has its threaded screw portion passing through an interiorly threaded member 128 fixedly attached to the front end of the platform member 68; said threaded screw 124 being adapted to be rotated in either direction by the knurled knob 130 which will cause the entire housing portion 108 (and the lower left roller member 20 and the lower left motor 38 depending therefrom) to move transversely (in this case, laterally in a horizontal plane) either toward or away from the lower right roller member 20 which is fixedly mounted to the platform member 68, as is its underlying driving motor 40. Thus, it can be seen that each assembly of one of the longitudinal roller members 20 and its driving motor can be transversely moved or adjusted relative to the others by controlled operation of the three knurled knobs 88, 102 and 130 and that this is true despite the fact that, in the example illustrated, the lower right longitudinal roller 20 and the lower right motor 40 are fixedly mounted relative to the platform member 68.

It should be noted that if desired, the same type of controllably adjustable mounting of the lower right roller member 20 and its driving motor 40 may be provided in a manner similar to the showing of the adjusting means for the left lower roller member 20 and its driving motor 38 or in the manner shown for providing adjusting movement of the upstanding bracket member 74, or any combination thereof may be employed, including a single double-acting screw which when turned in one direction will draw the two lower roller members 20 toward each other and which, when rotated in the other direction will cause said two roller members 20 to laterally horizontally separate from each other.

In the example illustrated, a particular type of gravity feeding means, indicated generally at 132, is shown for feeding the input workpieces 30 into the input end 26 of the workpiece-receiving recess 24, while a particular exemplary type of discharge trough or tray connected to the output end 28 of said recess is indicated at 34. However, the input feeding and output discharge structures shown are illustrative only, and are not intended to specifically limit the invention thereto.

In the exemplary form of the invention illustrated, a longitudinal guide and support member, indicated generally at 134, is provided and is longitudinally positioned between the two lowermost laterally adjacent roller members 20 in a relationship such as to be effectively cooperable for slideably contacting, supporting, and guiding a longitudinal workpiece 30 which has been inserted into the workpiece-receiving recess 24 as it is fed forwardly along the length thereof during the exterior honing of the workpiece 30.

In the example illustrated, the guide and support member 134 is adjustably mounted by a pair of screws 136 passing through a pair of vertical slots such as the ones shown at 138 in one of two adjacent guide plates 140 and 142. Also, the plate 140 has a slotted foot, as indicated at 141, fastened by fastening screws 143 to the platform 68. This makes it possible to vertically and horizontally adjust the top edge of the guide and support member 134 to whatever position is desired for proper support of various different diameters of longitudinal workpieces 30.

While not shown in detail, because such arrangements are well-known in the art, each of the three driving motors 36, 38, and 40 is adapted to be provided with appropriate wiring, connectors, control switches and the like (all conventional) for energizing and de-energizing the motors for controlling the output speed and/or output torque thereof and also for causing the reversible operation of any or all of same as needed or desired.

At least one of the roller members 20 comprises an abrasive honing flexible body member exteriorly flexibly provided with, and flexibly mounting, abrasive particle means whereby to bring about the desired workpiece surface honing action. While this can also be true of only two of the longitudinal roller members 20, in the example illustrated, it is true of each of the three roller members 20 illustrated and, in each case, the abrasive particle means comprises a cured plastic resin matrix material adhesively carrying a quantity of finely-divided particle abrasive material in a non-detachable flexibly-mounted manner.

In the example illustrated, each roller member taking the form of a flexible abrasive honing brush, indicated generally at 20 in each case, takes the form of a longitudinally disposed bristle-mounting base 144 provided with and firmly mounting corresponding base ends of a plurality of projecting flexible bristles 146 (usually Nylon bristles because of their flexibility and durability characteristics), with each of at least certain of the bristles 146 having an outer tip end 148 provided with and carrying the previously-mentioned abrasive particle means thereon in the form of an abrasive globule 150 surrounding and centered upon the bristle outer tip end 148.

It should be noted that, in the example illustrated, the so-called bristle-mounting base 144 is exactly coincident with the previously-mentioned corresponding longitudinal axis or axle 22 and may be said to comprise a longitudinal mounting core member preferably, although not necessarily in all cases, formed of two or more twisted wires which have locked within the twisted wire portions thereof so-called base ends 152 of the flexible "Nylon" bristles 146. Actually, in one practical construction, the "Nylon" bristles 146 may be doubled back after having been passed through the twisted wires comprising the longitudinal mounting core member 144 so that two or more of the circularly spaced bristles 146 will actually be interconnected at their base ends 152. However, this is primarily a matter of convenience of manufacture and the invention is not in any way limited to this particular construction or mode of mounting of the flexible Nylon bristles 146 so that they are both circularly spaced (actually spirally spaced around the mounting base or core of twisted wires 144), but are also longitudinally spaced along the length thereof.

Each of the abrasive globules 150, in the exemplary form best shown in FIG. 8, comprises a cured plastic resin matrix material (such as an epoxy resin for example) 156 adhesively carrying, in a firmly engaged substantially non-detachable manner, a quantity of finely-divided, particulate abrasive material (such as carborundum particles or any substantial equivalent) 158 which may be carried by dissemination throughout the plastic resin matrix material 156 and, therefore, being available at the surface thereof for abrasive honing action, or which may be substantially primarily carried by the exterior surface of the plastic resin matrix material 156 so as to, in effect, comprise an abrasive honing outer coat or layer attached on the outer surface of the globule 150. In one preferred form, an intervening bridging junction material 154 (usually a plastic resin material, although not specifically so limited in all forms of the invention) and having an affinity for both the plastic epoxy resin matrix material 156 and an affinity for the flexible Nylon plastic material comprising the mounting hristle tip end 148 may be employed so as to facilitate the firm mounting of each abrasive globule 150 in a manner effectively enhancing the firmness and non-removability characteristics of said mounting of the abrasive globule 150 on the corresponding bristle tip end 148. This further minimizes any possibility of there being any frangibility of the composite multi-phase material of which each abrasive globule 150 is formed (including junction material 154, plastic resin matrix material 156 and multiple abrasive particles 158), and prevents inadvertently chipping away or flaking away any portions of same relative to the remainder of the globule or relative to the flexible Nylon bristle tip end 148 as a result of intermittent or repeated impacting thereof with a workpiece surface which is to be honed.

While the above describes one particular form of flexible abrasive honing brush, it should be noted that the invention is not specifically limited thereto in all forms thereof, but may employ functionally equivalent flexible abrasive honing means for one or more of the roller members 20 provided that the abrasive particles are flexibly mounted so as to produce the advantageous end results achieved through the use of the present invention. Thus, flexible wheels peripherally mounting abrasive particles or having abrasive particles impregnated therethrough, or flexible pads or other equivalent structures having abrasive particles carried on the surface thereof or disseminated therethrough might be used, in certain instances in lieu of the flexible brush illustrated in FIG. 7 and described in detail hereinbefore, as possible equivalents (or partial equivalents thereof.) However, the present inventor has found no flexible honing structure which is as effective as a honing brush having extremely flexible Nylon bristles (or equivalent) carrying abrasive globules of the type shown in FIGS. 7 & 8 and described hereinbefore and the invention is primarily intended to employ such for each flexible abrasive honing means of the centerless flexible honing apparatus of the present invention.

It should be noted that the apparatus is effectively provided with forward feeding means (positioned for feeding contact with a longitudinal workpiece 30 axially received at the input end 26 of the workpiece-receiving recess 24), which is effectively power-operated to positively cause forward movement of each workpiece 30 along the longitudinal length of the recess 24 from the input end 26 to the output end 28 thereof. In the example illustrated, said effective forward feeding means is indicated generally at 160 and maybe said to comprise the longitudinal spiral arrangement or screw-like longitudinally spiral orientation of at least certain of the plurality of abrasive globules 150 which are so oriented with respect to the direction of powered rotation thereof as to effectively cause the forward feeding of each longitudinal workpiece 30 to occur by reason of the angularly-directed honing contact of each of the spirally arranged abrasive globules 150 with the exterior surface 162 of the workpiece 30 and, in particular, by reason of the forward force component thereof. It is clear that if the spiral arrangements of all three of the flexible abrasive honing brushes comprising the three roller members 20 are arranged in aiding cooperation (taking into account the directions of powered rotation of each of same), that the workpiece 30 will be fed through the recess 24 quite rapidly. It is also obvious that if the direction of rotation of one of the flexible honing brushes 20 is then reversed, or the spiral arrangement 160 of the abrasive globules 150 thereof is effectively reversed with the same direction of power rotation, this will tend to slow down the forward feeding movement of the workpiece 30 through the recess 24. This will be further enhanced if a second one of said flexible abrasive honing brushes 20 is similarly repositioned or oppositely rotated in a non-forward-movement aiding manner, which will cause the slowest possible kind of forward movement of the workpiece 30 through the recess 24. Also, the various motors can be rotated at different speeds which will modity the rate of forward movement of the workpiece 30 through the recess 24. Thus, it can be seen that the direction of spiral rotation, the speed of spiral rotation and the arrangement in forward-movement-aiding or forward-movement-impeding relationship of any or all of the flexible abrasive honing brushes 20 make it possible for the forward-feeding action to be of any desired extent as desired or needed in the honing of any particular part. This arrangement is well-suited to the finishing of shafting and spool valves of all types which are used in great numbers in various hydraulic valving systems, automatic transmissions and the like, where the finish is of great importance. Thus, a desired type of relatively smooth plateaued finish can be provided for such parts (or various other small cylindrical parts) in a high-production, relatively low-cost manner.

It should be noted that, while in one specific preferred form of the invention, one or more of the roller members 20 takes the form of a flexible abrasive honing body or member exteriorly carrying abrasive particles in a firmly engaged non-detachable manner, and that while in one particular version thereof, said abrasive honing body member is of a quite flexible type mounting the abrasive particles in a very flexible manner (in one exemplary illustrated form comprising a flexible brush with a plurality of flexible bristles mounting the abrasive particles in the form of abrasive globules carried on the outer bristle tip ends of such a brush), it should be clearly noted that the terms "flexible" and "flexibly" are relative only and are to be construed in certain cases as ranging from the very flexible nylon bristle mounting illustrated to somewhat less flexible mounting on less flexible brushes or body members of varying degrees of flexibility, compressibility or yieldability and which may take substantially solid cylindrical form rather than brushlike form in certain cases ranging clear down to solid cylindrical wheel-like or roller-like constructions of minimum flexibility exteriorly carrying the particulate abrasive material in a substantially non-detachable manner, with the latter version being adapted for use in removing more exterior material from a workpiece (in a manner which may be considered to be analogous to machining or the like), while the more flexible mountings are intended for honing or finishing a surface with less surface material removal (except for folded-over, cut, or torn microprofile metal surface portions) and especially for plateauing a surface finish. Broadly speaking, the present invention is intended to include such a range of variations of the one or more abrasive honing body members and the two terms "flexible" and "flexibly" are to be construed in the light of this statment.

It should be understood that the figures and the specific description thereof set forth in this application are for the purpose of illustrating the present invention and are not to be construed as limiting the present invention to the precise and detailed specific structures shown in the figures and specifically described hereinbefore. Rather, the real invention is intended to include substantially equivalent constructions embodying the basic teachings and inventive concept of the present invention.

What is claimed is:

1. Centerless flexible external honing apparatus for honing curved exterior surfaces of an exteriorly curved workpiece, comprising: a workpiece-receiving assembly of at least three similarly longitudinally adjacently oriented longitudinal effective roller members, at least certain of which are provided with similarly longitudinally oriented transversely spaced longitudinal axes arranged cross-sectionally in a generally triangular configuration, at least certain of which are mounted for powered rotation, in each case, around the corresponding longitudinal axis and with the lateral spacing between said three longitudinal effective roller members being positioned so as to effectively define a longitudinal workpiece-receiving recess therebetween adapted to axially longitudinally receive, at one end of said assembly to effective roller members, an exteriorly curved workpiece which is to be longitudinally fed forwardly along the length of said workpiece-receiving recess and to forwardly exit from an opposite end thereof for discharge as a suface-finished and exteriorly plateaued workpiece, said three effective roller members being provided with power-rotating means coupled thereto for positively power-rotating each of said effective roller members in a deisred direction around its longitudinal axis; each of said longitudinal effective rollers members comprising an abrasive honing flexible body member exteriorly flexible provided with and flexibly mounting abrasive means, said abrasive means comprising a matrix material adhesively carrying in a firmly engaged, substantially non-detachable manner, a quantity of finely-divided particulate abrasive material; and the power rotating means formed of torque-supplying means and power-transmission means coupling same to each driven one of said longitudinal roller members in a desired manner; each abrasive honing flexible body member comprising an abrasive honing flexible brush taking the form of a longitudinally disposed bristle-mounting base provided with and firmly mounting corresponding base ends of a plurality of projecting flexible plastic bristles, with each of at least certain of said bristles having an outer end provided with and carrying said abrasive means thereon in the form of an abrasive globule surrounding and centered upon said bristle outer end, each longitudinally disposed bristle-mounting base comprising a longitudinal mounting core member firmly engaging and holding inner ends of said plurality of projecting bristles, both along the length of said mounting core member and continuously helically spirally around said longitudinal mounting core member whereby to cause said plurality of bristles to essentially define a cylindrical flexible brush at any particular cross-sectional location with the bristle tips carrying said abrasive globules being positioned around and along each longitudinal mounting core member in a continuous screw-like longitudinally helically spiral orientation; the mounting of, and the relative coupling between, the three abrasive brushes and the torque-supplying means and power transmission means being arranged so that a relationship exists between a first one of said abrasive brushes, having a first plurality of abrasive globules, and a second one of said abrasive brushes, having a second plurality of said abrasive globules, and the torque-supplying means and power transmission means coupled thereto, with each abrasive brush being so coupled as to be power-rotated in a rotary direction opposite to the forward twisting screw-thread direction of the longitudinally heically spirally arranged first and second pluralites of abrasive globules to effect a positive forward feeding of a workpiece along the longitudinal length of said workpiece-receiving recess from an input at said one end to an output at said oppoiste end, and arranged so that an effectively-reversed, advancement-opposing relationship exists between the third one of said abrasive brushes and the torque-supplying means and power transmssion means coupled thereto, with the third one of said abrasive brushes being so coupled as to be powered-rotated in a rotary direction the same as the forward twisting screw-thread direction of a longitudinally helically spirally arranged third one of said plurality of abrasive globules carried by said third one of said abrasive brushes, thereby casuing the effective frictional overriding of, and the consequent honing functioning of, said third plurality of abrasive globules by the greater number of said first and second pluralities of non-slipping abrasive globules.

2. Centerless flexible external honing apparatus as defined in claim 1, including a longitudinal and guide support member longitudinally positioned between two lowermost laterally adjacent similarly longitudinally oriented ones of said effective roller members and cooperable for slideably contacting, supporting, and guiding a longitudinal workpiece inserted into said workpiece-receiving recess between the three transversely adjacent longitudinal effective roller members as such a workpiece is fed therethrough while having its exterior surface honed and plateued.

* * * * *